US010747165B2

(12) United States Patent
Asakawa

(10) Patent No.: US 10,747,165 B2
(45) Date of Patent: Aug. 18, 2020

(54) IMAGE FORMING SYSTEM WHICH HANDLES A SHEET BUNCH INCLUDING A SHEET WITH A DEFECT BASED ON A NUMBER OF SHEETS REMAINING UNDER TRANSPORTATION IN THE SYSTEM

(71) Applicant: KONICA MINOLTA, INC., Chiyoda-ku, Tokyo (JP)

(72) Inventor: Minoru Asakawa, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/597,348

(22) Filed: Oct. 9, 2019

(65) Prior Publication Data

US 2020/0117135 A1 Apr. 16, 2020

(30) Foreign Application Priority Data

Oct. 12, 2018 (JP) ..... 2018-193073

(51) Int. Cl.
*G03G 15/00* (2006.01)
*G03G 21/16* (2006.01)

(52) U.S. Cl.
CPC ..... *G03G 21/1638* (2013.01); *G03G 15/5062* (2013.01); *G03G 15/55* (2013.01)

(58) Field of Classification Search
CPC ..... G03G 15/5062; G03G 15/55; G03G 21/1638; B41J 29/38
See application file for complete search history.

(56) References Cited

U.S. PATENT DOCUMENTS

2017/0023901 A1* 1/2017 Asakawa ..... G03G 15/70
2018/0056679 A1* 3/2018 Vestjens ..... G03G 15/55
2018/0059603 A1* 3/2018 Miyahara ..... H04N 1/0005
2018/0157446 A1* 6/2018 Fukuda ..... B41J 13/0009
2020/0028976 A1* 1/2020 Oki ..... H04N 1/00005

FOREIGN PATENT DOCUMENTS

JP 2015120264 A 7/2015

* cited by examiner

*Primary Examiner* — Sophia S Chen
(74) *Attorney, Agent, or Firm* — Holtz, Holtz & Volek PC

(57) ABSTRACT

An image forming system which reduces the number of sheets invalidated upon detection of an image defect, without an escape area. The image forming system includes an image forming section, an image reading section, a post-processing section, and a controller. When the controller detects an image defect on a sheet, if the number of sheets from the spoilage sheet to the sheet in the first bunch of sheets on the border of the bunch is smaller than the number of sheets from the spoilage sheet to the last sheet, the controller continues the process to make sheet bunches up to the sheet bunch including the last sheet. Then, the controller starts recovery operation for copies (bunches) remaining to be made as requested by job information plus a copy equivalent to the sheet bunch including the spoilage sheet.

7 Claims, 12 Drawing Sheets

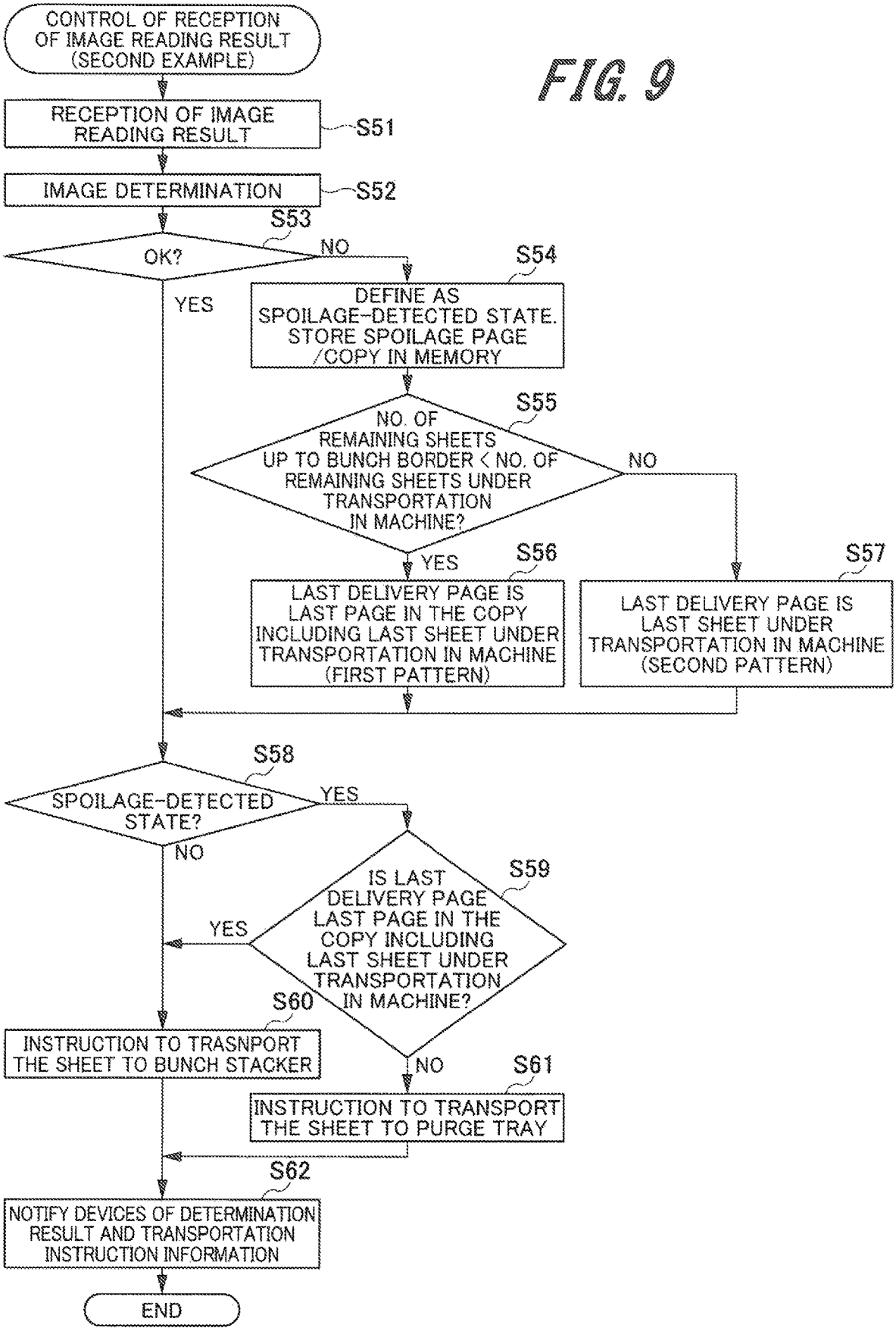
FIG. 9
CONTROL OF RECEPTION OF IMAGE READING RESULT (SECOND EXAMPLE)
RECEPTION OF IMAGE READING RESULT
S51
IMAGE DETERMINATION
S52
S53
OK?
NO
YES
S54
DEFINE AS SPOILAGE-DETECTED STATE. STORE SPOILAGE PAGE /COPY IN MEMORY
S55
NO. OF REMAINING SHEETS UP TO BUNCH BORDER < NO. OF REMAINING SHEETS UNDER TRANSPORTATION IN MACHINE?
NO
YES
S56
LAST DELIVERY PAGE IS LAST PAGE IN THE COPY INCLUDING LAST SHEET UNDER TRANSPORTATION IN MACHINE (FIRST PATTERN)
S57
LAST DELIVERY PAGE IS LAST SHEET UNDER TRANSPORTATION IN MACHINE (SECOND PATTERN)
S58
SPOILAGE-DETECTED STATE?
YES
NO
S59
IS LAST DELIVERY PAGE LAST PAGE IN THE COPY INCLUDING LAST SHEET UNDER TRANSPORTATION IN MACHINE?
YES
NO
S60
INSTRUCTION TO TRASNPORT THE SHEET TO BUNCH STACKER
S61
INSTRUCTION TO TRANSPORT THE SHEET TO PURGE TRAY
S62
NOTIFY DEVICES OF DETERMINATION RESULT AND TRANSPORTATION INSTRUCTION INFORMATION
END

FIG. 13

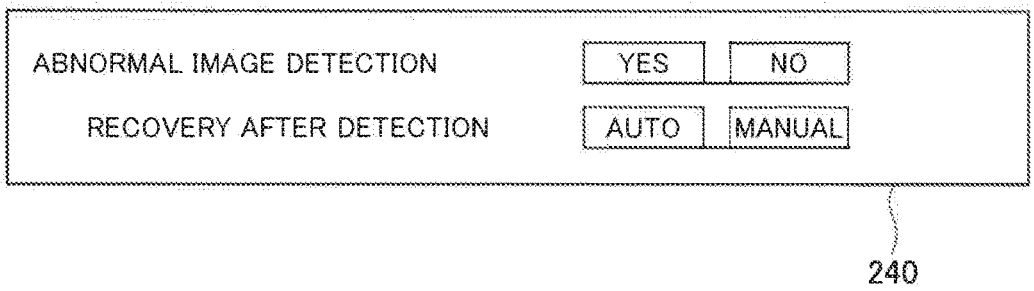

FIG. 14

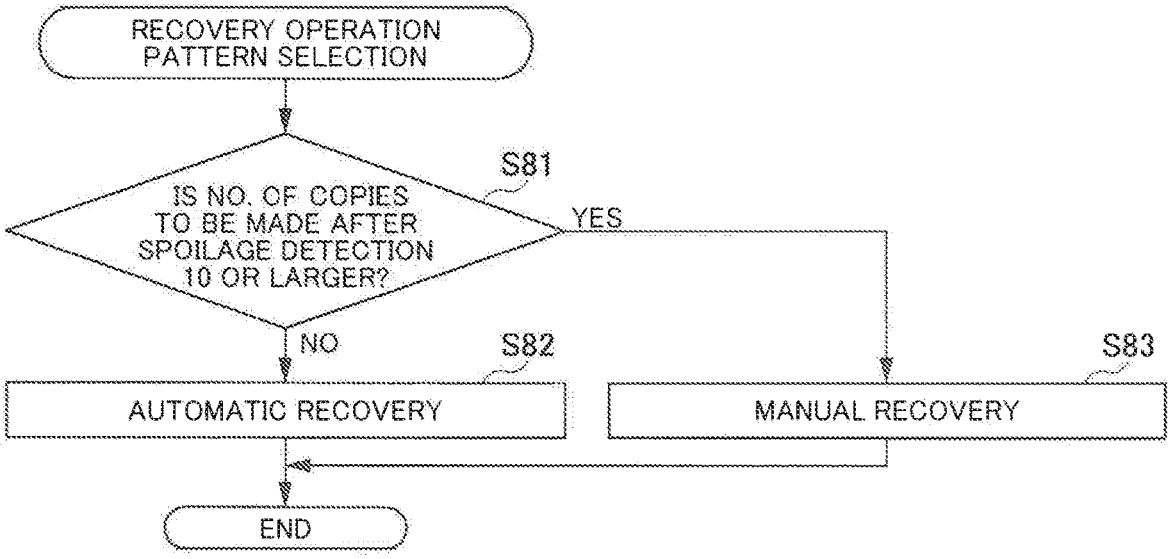

FIG. 15

| AUTO/ MANUAL | SPOILAGE BUNCH YES/NO | EXAMPLES OF GUIDANCE MESSAGES | THE MESSAGE APPEARS: |
|---|---|---|---|
| AUTO | YES | THERE IS A DEFECTIVE BOOKLET REMOVE THE XX-TH BOOKLET. | AT THE END OF JOB |
| | NO | A DEFECTIVE IMAGE SHEET HAS BEEN DELIVERED TO PURGE TRAY. | |
| MANUAL | YES | THERE IS A DEFECTIVE BOOKLET. REMOVE THE XX-TH BOOKLET. | BEFORE START OF RECOVERY |
| | NO | A DEFECTIVE IMAGE HAS BEEN GENERATED. CHECK THE SHEETS IN THE PURGE TRAY. | |

IMAGE FORMING SYSTEM WHICH HANDLES A SHEET BUNCH INCLUDING A SHEET WITH A DEFECT BASED ON A NUMBER OF SHEETS REMAINING UNDER TRANSPORTATION IN THE SYSTEM

CROSS-REFERENCE TO RELATED APPLICATIONS

The entire disclosure of Japanese Patent Application No. 2018-193073, filed on Oct. 12, 2018, is incorporated herein by reference in its entirety.

BACKGROUND

Technological Field

The present invention relates to an image forming system which forms an image on a sheet of paper and makes a bunch of sheets by bundling a plurality of sheets.

Description of the Related Art

An image forming system includes an image forming device for forming an image on a sheet of paper and a paper feed device for supplying sheets to the image forming device. The image forming device forms an image on a sheet according to output job information. In recent years, an image forming system has been proposed in which an image reader for reading the image formed on a sheet by an image forming device is provided to determine whether the image is defective or not.

For example, the technique described in Patent Literature 1 (JP-A-2015-120264) is a technique which determines whether an image is defective or not. Patent Literature 1 describes the technique that in order to print a plurality of copies of a job including a plurality of pages, printing is alternately made in page number order for each copy (a set of collated pages) until a defective printed sheet is detected, and non-defective printed sheets are sorted on a copy-by-copy basis and transported to a plurality of delivery trays. Patent Literature 1 also describes that if a defective printed sheet is detected, the defective printed sheet is transported to a waste tray, the non-defective printed sheets following the defective printed sheet are transported to an escape area, and for a next copy without a detected defective printed sheet, printing is continued in page number order until the same page as the defective page is reprinted.

CITATION LIST

Patent Literature

Patent Literature 1: JP-A-2015-120264

SUMMARY

However, since the technique described in Patent Literature 1 requires an escape area to which non-defective sheets remaining in the machine are transported when an image defect on a sheet is detected, inevitably the whole image forming system is structurally complicated.

The present invention has been made in view of the above problem and has an object to provide an image forming system which reduces the number of sheets which are invalidated upon detection of an image defect, without an escape area.

To solve the abovementioned problem and achieve at least the abovementioned object, according to an aspect of the present invention, an image forming system reflecting one aspect of the present invention comprises an image forming section, an image reading section, a post-processing section, and a controller. The image forming section forms an image on a sheet according to job information. The image reading section reads the image formed on the sheet by the image forming section. The post-processing section is located downstream of the image reading section in the sheet transportation direction and performs post-processing on a bunch of sheets made by bundling a specified number of sheets. The controller determines whether an image defect has occurred on the sheet or not according to image reading result information from the image reading section and makes detection.

When the controller detects an image defect on the sheet, if the number of sheets from the spoilage sheet bearing the image defect to the sheet in the first sheet bunch as the sheet bunch including the spoilage sheet, on the border with a next sheet bunch, is smaller than the number of sheets from the spoilage sheet to the last sheet as the most upstream sheet in the transportation direction among sheets reserved for processing in the image forming section, the controller continues a process to make bunches up to the sheet bunch including the last sheet and then starts recovery operation for copies remaining to be made as requested by the job information plus a copy equivalent to the sheet bunch including the spoilage sheet.

BRIEF DESCRIPTION OF THE DRAWINGS

The advantages and features provided by an embodiment of the invention will become more fully understood from the detailed description given hereinbelow and the appended drawings which are given by way of illustration only, and thus are not intended as a definition of the limits of the present invention:

FIGS. 7A, 7B, and 7C are explanatory diagrams which show a first pattern of the first example of control upon reception of an image reading result, in which FIG. 7A shows sheets under transportation upon spoilage detection, FIG. 7B shows transportation stop upon spoilage detection, and FIG. 7C shows recovery operation;

FIGS. 8A, 8B, and 8C are explanatory diagrams which show a second pattern of the first example of control upon reception of image reading results, in which FIG. 8A shows sheets under transportation upon spoilage detection, FIG. 8B shows transportation stop upon spoilage detection, and FIG. 8C shows recovery operation;

FIG. 9 is a flowchart which shows a second example of control upon reception of an image reading result in the image forming system according to the embodiment of the present invention;

FIGS. 10A, 10B, and 10C are explanatory diagrams which show the first pattern of the second example of control upon reception of an image reading result, in which FIG. 10A shows sheets under transportation upon spoilage detection, FIG. 10B shows transportation stop upon spoilage detection, and FIG. 10C shows recovery operation;

FIGS. 11A and 11B are explanatory views which show an example of post-processing performed on a spoilage bunch and a normal bunch, in which FIG. 11A shows the normal bunch and FIG. 11B shows the spoilage bunch;

FIGS. 12A and 12B are explanatory views which show another example of post-processing performed on a spoilage bunch and a normal bunch, in which FIG. 12A shows the normal bunch and FIG. 12B shows the spoilage bunch;

FIG. 13 is an explanatory view which shows an example of what is displayed on the operation display panel in the image forming system according to the embodiment of the present invention;

FIG. 14 is a flowchart which shows a recovery operation (resetting operation) pattern selection process in the image forming system according to the embodiment of the present invention; and FIG. 15 is a table which explains examples of guidance messages in the image forming system according to the embodiment of the present invention.

DETAILED DESCRIPTION OF EMBODIMENTS

Hereinafter, an embodiment of the present invention will be described with reference to the drawings. However, the scope of the invention is not limited to the disclosed embodiment. The image forming system according to the embodiment of the present invention will be described referring to FIGS. 1 to 15. In the figures, the same elements are designated by the same reference signs.

1. Embodiment

1-1. Configuration of the Image Forming System

Figure 1:
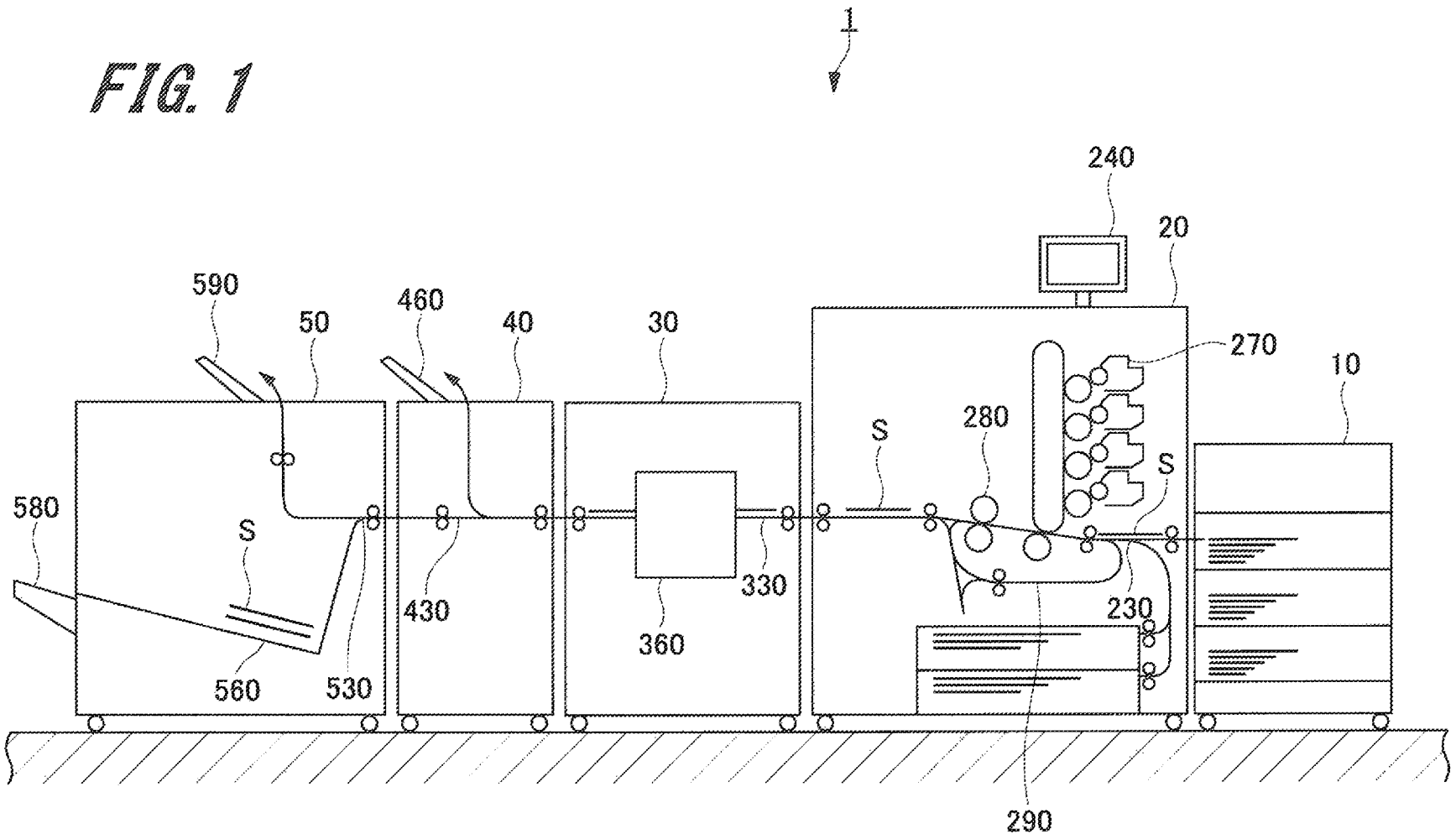
FIG. 1 is a schematic configuration diagram which shows the general configuration of an image forming system according to an embodiment of the present invention.

First, an explanation will be given of the general configuration of the image forming system according to the embodiment of the present invention (hereinafter called "this example"). FIG. 1 is a schematic general configuration diagram of an image forming system 1 in this example.

As shown in FIG. 1, the image forming system 1 includes a large-capacity paper feed unit 10 for supplying sheets S, an image forming device 20, an image reader 30, a spoilage delivery device 40, and a post-processing device 50. The large-capacity paper feed unit 10, image forming device 20, image reader 30, spoilage delivery device 40, and post-processing device 50 are connected to a network such as a LAN and connected with each other through the network. In the image forming system 1, the large-capacity paper feed unit 10, image forming device 20, image reader 30, spoilage delivery device 40, and post-processing device 50 are arranged in order from upstream in the path for transporting sheets S and connected in series.

The large-capacity paper feed unit 10 is located on the most upstream side of the image forming system 1. It has a plurality of paper feed trays and can house a large quantity of sheets. The large-capacity paper feed unit 10 supplies the sheets S housed in a paper feed tray to the image forming device 20 through a paper conveyor 130 (see FIG. 2).

The image forming device 20 forms an image on a supplied sheet S according to output job information and image data. The image forming device 20 adopts an electrophotographic method to form an image on a sheet S. The image forming device 20 includes a paper conveyor 230, an operation display panel 240, an image forming section 270, a fixing section 280, and an inversion conveyor 290.

The operation display panel 240 is located over the housing of the image forming device 20. The operation display panel 240 includes a display panel and a touch panel (operation section) which are placed one upon the other so as to enable operation by the user and display of information.

The paper conveyor 230 transports the sheet S supplied from the large-capacity paper feed unit 10 to the image forming section 270, the fixing section 280, the inversion conveyor 290, and the image reader 30 which will be described later.

The image forming section 270 includes, for example, image forming units for a plurality of colors (cyan, magenta, yellow, black, etc.) and can form a color image on a sheet. The fixing section 280 to which the sheet with a toner image formed thereon is transported is located on the downstream of the image forming section 270 in the sheet transportation direction.

The fixing section 280 fixes the toner image transferred on the sheet S by pressurizing and heating the transported sheet S. The sheet S subjected to the fixing process by the fixing section 280 is transported to the inversion conveyor 290 or image reader 30 by the paper conveyor 230.

The inversion conveyor 290 includes an inversion section which inverts the sheet S. The sheet S reversed upside down or back and forth by the inversion section is passed through the inversion conveyor 290 and transported to the upstream side of the image forming section 270 or the downstream side of the fixing section 280.

The image reader 30 is a device which reads the image formed on the sheet S transported from the image forming device 20. The image reader 30 includes a paper conveyor 330 for transporting sheets and an image reading section 360 for reading an image. The image reading section 360 lies above and below the paper conveyor 330. The image reading section 360 reads the information (image) formed on the sheet S by scanning the sheet S transported by the paper conveyor 330 optically and generates read image data.

The paper conveyor 330 transports the sheet S delivered from the image forming section 270 through the image reading section 360 to the spoilage delivery device 40.

The spoilage delivery device 40 receives the sheet S transported from the image reader 30 and transports it to the post-processing device 50. The spoilage delivery device 40 includes a paper conveyor 430 and a purge tray 460. A sheet S judged as having an image defect by a controller 200 which will be described later (see FIG. 3), or a so-called spoilage sheet, is delivered to the purge tray 460. The paper conveyor 430 transports the sheet S to the purge tray 460 or the post-processing device 50 located downstream.

The post-processing device 50 performs post-processing for a plurality of sheets S transported from the spoilage delivery device 40. The post-processing device 50 is, for example, a stapling device for stapling sheets S, a punching device for punching sheets S, a bookbinding device for bundling a plurality of sheets S to make a booklet, or another type of post-processing device.

Figure 2:
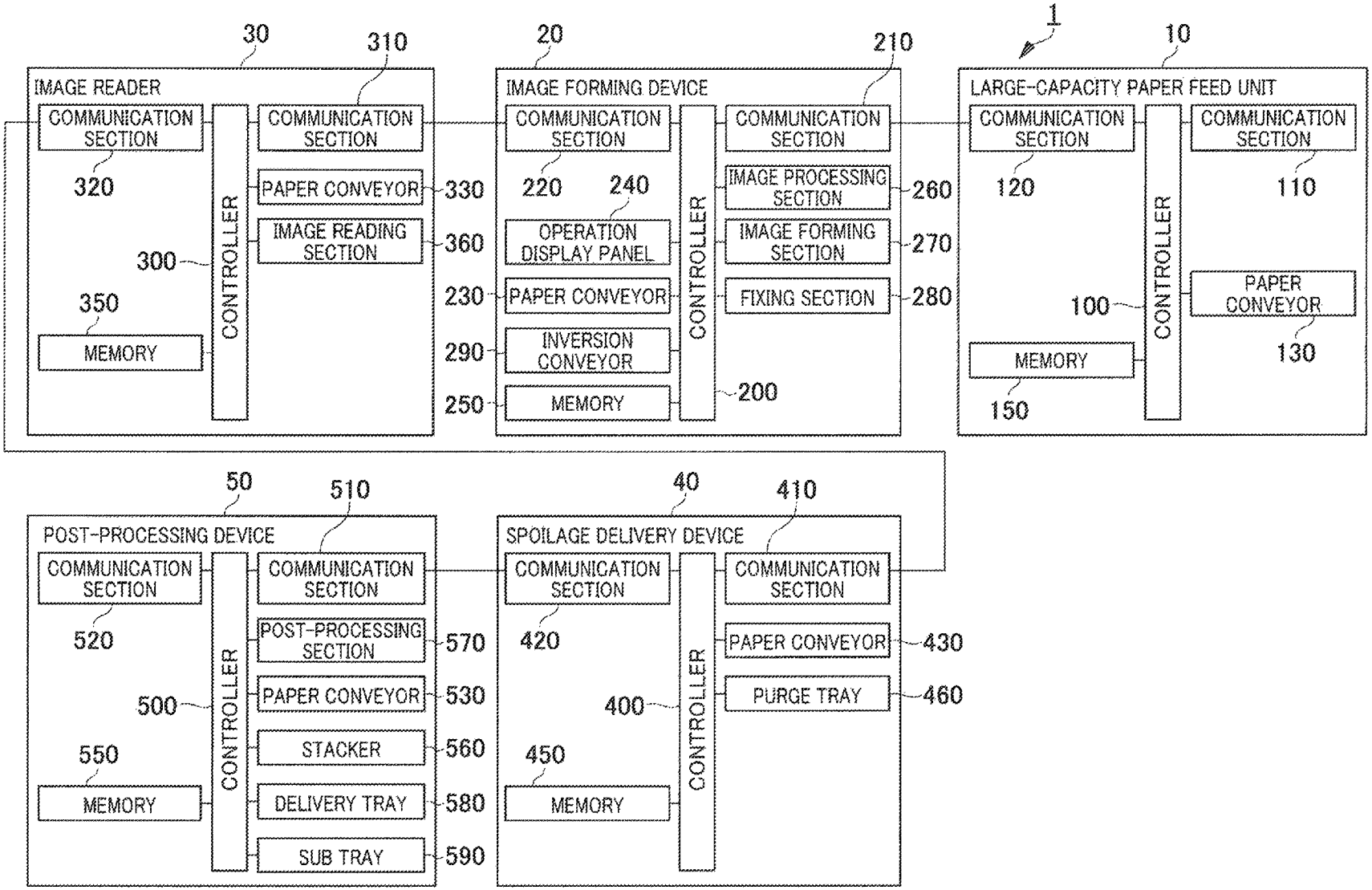
FIG. 2 is a block diagram which shows the hardware configuration of the image forming system according to the embodiment of the present invention.

The post-processing device 50 includes a paper conveyor 530, a stacker 560, a delivery tray 580, a sub tray 590, and a post-processing section 570 (see FIG. 2). In the stacker 560, the sheets S transported by the paper conveyor 530 are stacked. Then, when a specified number of sheets S to be processed are stacked in the stacker 560, the post-processing section 570 performs specified post-processing on the bunch of sheets. The bunch of sheets subjected to post-processing by the post-processing section 570 is delivered to the delivery tray 580.

The sub tray 590 is located over the housing of the post-processing device 50. Like the purge tray 460 of the spoilage delivery device 40, spoilage sheets are delivered to the sub tray 590.

1-2 Hardware Configurations of the Various Devices

Next, the hardware configurations of the various devices will be described referring to FIGS. 2 and 3.

FIG. 2 is a block diagram which shows the hardware configurations of the various devices of the image forming system. FIG. 3 is an explanatory diagram which shows how information on spoilage detection is transmitted.

First, the hardware configuration of the large-capacity paper feed unit 10 will be described.

As shown in FIG. 2, the large-capacity paper feed unit 10 includes a controller 100, communication sections 110 and 120, the paper conveyor 130, and a memory 150.

The controller 100 has, for example, a CPU (Central Processing Unit). The controller 100 is connected to the communication sections 110 and 120, paper conveyor 130, and memory 150 through a system bus to control the entire large-capacity paper feed unit 10.

The memory 150 is a volatile memory such as a RAM or a large-capacity nonvolatile memory. The memory 150 stores the program to be executed by the controller 100 or the like and is used as a working area for the controller 100.

The communication section 110 performs transmission and reception of data with an external device (client terminal, management device server, mobile terminal, etc.) of the image forming system 1. The communication section 120 performs transmission and reception of data with the communication section 210 of the image forming device 20.

Next, the hardware configuration of the image forming device 20 will be described.

The image forming device 20 includes the controller 200, communication sections 210 and 220, the paper conveyor 230, the operation display panel 240, a memory 250, an image processing section 260, the image forming section 270, the fixing section 280, and the inversion conveyor 290.

The controller 200 has, for example, a CPU (Central Processing Unit). The controller 200 is connected to the communication sections 210 and 220, paper conveyor 230, operation display panel 240, memory 250, image processing section 260, image forming section 270, fixing section 280, and inversion conveyor 290 through the system bus to control the entire image forming device 20. Also, the controller 200 controls the large-capacity paper feed unit 10, image reader 30, spoilage delivery device 40, and post-processing device 50 through the communication sections 210 and 220. In short, in this example, the controller 200 controls the entire image forming system 1.

Figure 3:
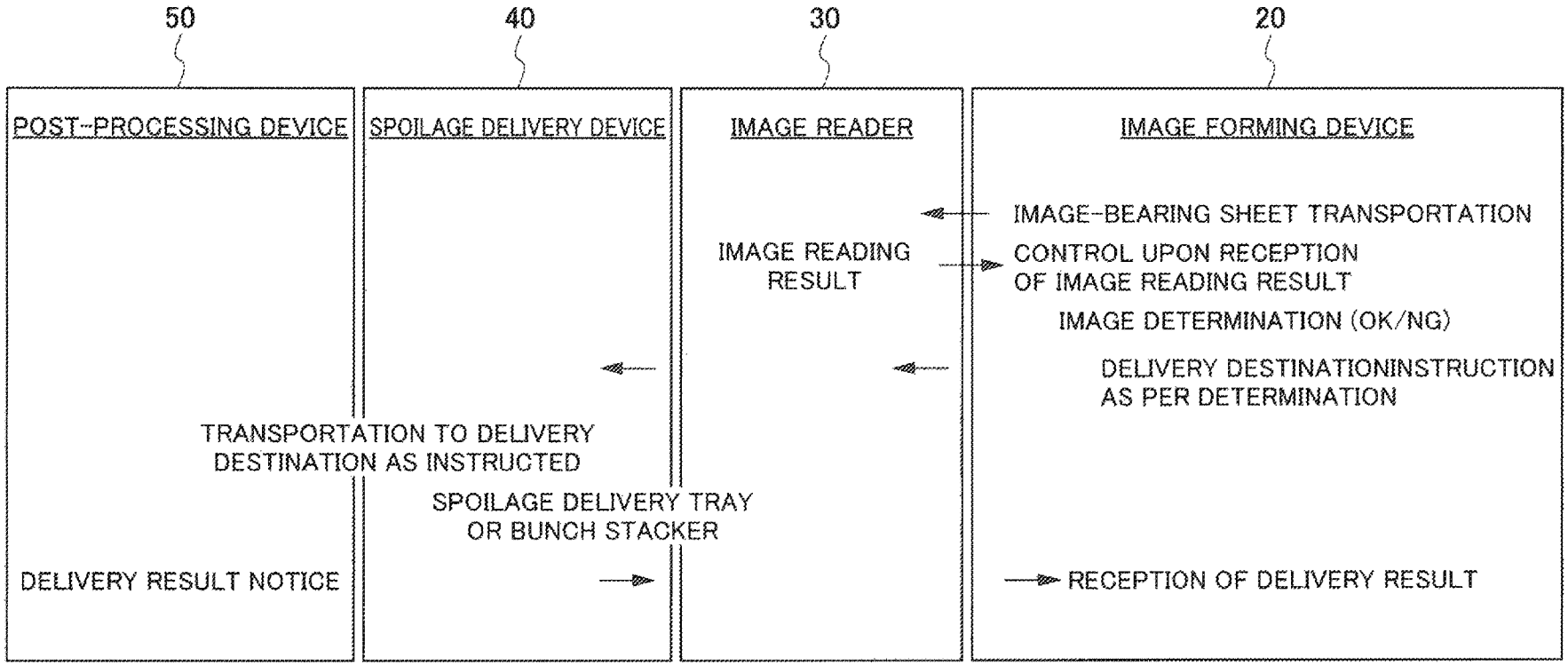
FIG. 3 is an explanatory diagram which shows how information is transmitted in the image forming system according to the embodiment of the present invention.

As shown in FIG. 3, the controller 200 receives information on the result of image reading from the image reader 30. Then, the controller 200 judges whether the sheet is normal or abnormal, according to the image reading result information, controls various devices according to the determination result and issues a delivery instruction. Also, according to the image reading result information, the controller 200 controls the transportation of an image-bearing sheet and operation at the time of reception of an image reading result, which will be described later. Furthermore, the controller 200 receives a delivery result notice from the post-processing device 50 which will be described later.

The memory 250 is a volatile memory such as a RAM or a large-capacity nonvolatile memory. The memory 250 stores the program to be executed by the controller 200 or the like and is used as a working area for the controller 200. The memory 250 also counts the number of spoilage bunches as bunches of sheets including spoilage.

The communication section 210 performs transmission and reception of data with the communication section 120 of the large-capacity paper feed unit 10. Also, the communication section 220 performs transmission and reception of data with the communication section 310 of the image reader 30. The communication sections 210 and 220 also perform transmission and reception of data with the external device of the image forming system 1.

The image processing section 260 acquires image data from the job information received from outside and performs image processing. The image processing section 260 performs image processing tasks, including shading correction, image density adjustment, and image compression, on the received image data as necessary under the control by the controller 200. Then, the image data processed by the image processing section 260 is sent to the image forming section 270. The image forming section 270 receives the image data processed by the image processing section 260 and forms an image on a sheet S according to the image data.

The operation display panel 240 is a touch panel as a display such as a liquid crystal display unit (LCD) or organic ELD (Electro Luminescence Display). This operation display panel 240 is an example of the output section and input section which displays an instruction menu for the user, information concerning the acquired image data, and the like. The operation display panel 240 includes a plurality of keys and receives data entered through key operation by the user such as various instructions, characters, and numerals, and sends an input signal to the controller 200.

Next, the hardware configuration of the image reader 30 will be described.

The image reader 30 includes a controller 300, communication sections 310 and 320, the paper conveyor 330, the image reading section 360, and a memory 350.

The controller 300 has, for example, a CPU (Central Processing Unit). The controller 300 is connected to the communication sections 310 and 320, paper conveyor 330, memory 350, and image reading section 360 through the system bus to control the entire image reader 30.

The memory 350 is a volatile memory such as a RAM or a large-capacity nonvolatile memory. The memory 350 stores the program to be executed by the controller 300 or the like and is used as a working area for the controller 300.

The communication section 310 performs transmission and reception of data with the communication section 220 of the image forming device 20. As shown in FIG. 3, the communication section 310 sends the image reading result information read by the image reading section 360 to the communication section 220 of the image forming device 20. Furthermore, the communication section 310 receives the image determination result from the image forming device 20 through the communication section 220. Also, the communication section 320 performs transmission and reception of data with the communication section 410 of the spoilage delivery device 40.

Next, the hardware configuration of the spoilage delivery device 40 will be described.

The spoilage delivery device 40 includes a controller 400, communication sections 410 and 420, the paper conveyor 430, a memory 450, and the purge tray 460.

The controller 400 has, for example, a CPU (Central Processing Unit). The controller 400 is connected to the communication sections 410 and 420, paper conveyor 430, memory 450, and purge tray 460 through the system bus to control the entire spoilage delivery device 40.

The memory 450 is a volatile memory such as a RAM or a large-capacity nonvolatile memory. The memory 450 stores the program to be executed by the controller 400 or the like and is used as a working area for the controller 400.

The communication section 410 performs transmission and reception of data with the communication section 320 of the image reader 30. As shown in FIG. 3, the communication section 410 receives delivery instruction information from the image forming device 20 through the communication sections 220 and 320. Then, the controller 400 controls the paper conveyor 430 according to the received delivery instruction information and transports the sheet S to the post-processing device 50 or purge tray 460. Also, the communication section 420 performs transmission and reception of data with the communication section 510 of the post-processing device 50.

Next, the hardware configuration of the post-processing device 50 will be described.

The post-processing device 50 includes a controller 500, communication sections 510 and 520, the paper conveyor 530, a memory 550, the stacker 560, the post-processing section 570, the delivery tray 580, and the sub tray 590.

The controller 500 has, for example, a CPU (Central Processing Unit). The controller 500 is connected to the communication sections 510 and 520, paper conveyor 530, memory 550, stacker 560, post-processing section 570, delivery tray 580, and sub tray 590 through the system bus to control the entire post-processing device 50.

The memory 550 is a volatile memory such as a RAM or a large-capacity nonvolatile memory. The memory 550 stores the program to be executed by the controller 500 or the like and is used as a working area for the controller 500.

The communication section 510 performs transmission and reception of data with the communication section 420 of the spoilage delivery device 40. As shown in FIG. 3, the communication section 510 receives delivery instruction information from the image forming device 20 through the communication sections 220, 320, and 420. Then, the controller 500 controls the post-processing section 570 according to the received delivery instruction information. Furthermore, the controller 500 controls the paper conveyor 530 according to the received delivery instruction information and transports the sheet S to the stacker 560, delivery tray 580, or sub tray 590. The communication section 510 sends the delivery result to the image forming device 20.

The post-processing section 570 performs specified post-processing on the bunch of sheets stacked in the stacker 560 according to an instruction from the controller 500.

2. Examples of Operation

Next, examples of operation of the image forming system 1 configured as mentioned above will be described referring to FIGS. 4 to 12. In the examples of operation mentioned below, an explanation is given of a job that a plurality of sheets S are bundled into a bunch of sheets and a plurality of such sheet bunches are made.

2-1. Execution of the Job and Transportation

[Control of Transportation of Image-Bearing Sheets]

First, execution of the job and transportation, or control of transportation of image-bearing sheets will be described referring to FIG. 4.

Figure 4:
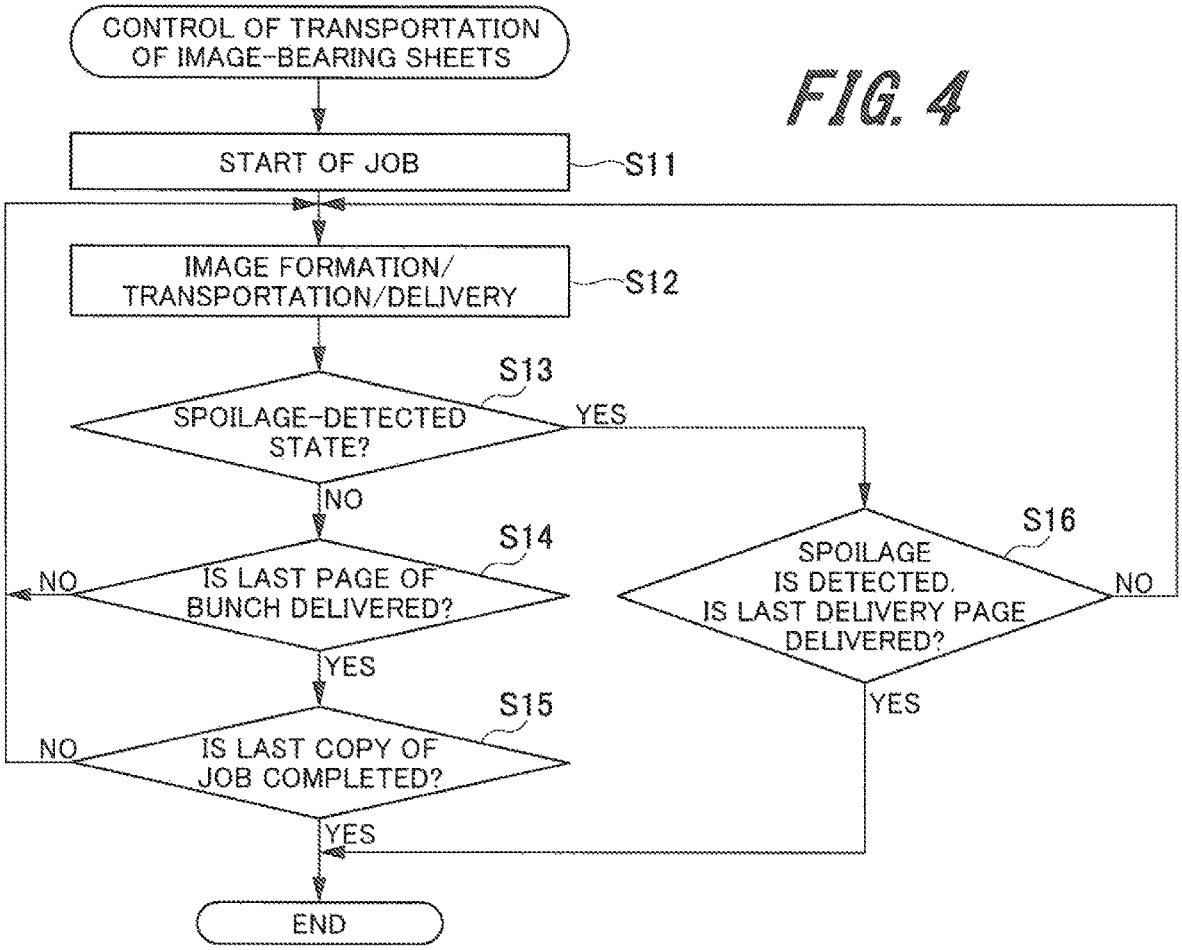
FIG. 4 is a flowchart which shows the control of transportation of an image-bearing sheet in the image forming system according to the embodiment of the present invention.

FIG. 4 is a flowchart which shows the control of transportation of image-bearing sheets.

As shown in FIG. 4, when the controller 200 of the image forming device 20 (hereinafter simply called the "controller") receives job information from the external device, it sends the received job information to the devices 10, 30, 40, and 50. Then, the image forming system 1 starts the job according to the received job information (Step S11). Then, the controller 200 controls the paper conveyor 230, image forming section 270, and devices 10, 30, 40, and 50 to form an image and transport and deliver the sheet (Step S12).

In addition, the controller 200 receives the image reading result information from the image reader 30 and makes a determination on the image. Details of operation at the time of reception of the image reading result will be described later. Then, the controller 200 determines whether the current state is a spoilage-detected state in which a spoilage sheet has been detected (Step S13).

If at Step S13 the controller 200 determines that the current state is not a spoilage-detected state (determination at Step S13: NO), the controller 200 determines whether the last page of the bunch of sheets has been delivered or not (Step S14). If at Step S14 the controller 200 determines that the last page of the bunch of sheets has not been delivered (determination at Step S14: NO), the controller 200 returns to Step S12 and continues the job.

On the other hand, if at Step S14 the controller 200 determines that the last page of the bunch of sheets has been delivered, it determines whether the process to make the last copy (bunch) for the job, namely the process to make the specified number of copies (bunches) for the job, has been completed (Step S15). If at Step S15 the controller 200 determines that the last copy has not been completed (determination at Step S15: NO), the controller 200 returns to Step S12 and continues the job. On the other hand, if at Step S15 the controller 200 determines that the last copy has been completed (determination at Step S15: YES), the controller 200 ends the job.

On the other hand, if at Step S13 the controller 200 determines that the current state is a spoilage-detected state (determination at Step S13: YES), the controller 200 determines whether the last delivery page S2 which is set upon spoilage detection (see FIGS. 7A to 7C, 8A to 8C, and 10A to 10C) has been delivered or not (Step S16). The process of setting the last delivery page S2 to be used at Step S16 will be described later.

If at Step S16 the controller 200 determines that the last delivery page S2 has not been delivered yet (determination at Step 16: NO), the controller 200 returns to Step S12 and continues the job. If at Step S16 the controller 200 determines that the last delivery page S2 has been delivered (determination at Step S16: YES), it stops the transportation upon spoilage detection and then proceeds to the resetting or so-called recovery operation process as shown in FIG. 5 which will be described later.

[Control of Transportation of Image-Bearing Sheets (in Recovery Operation)]

Next, how transportation of image-bearing sheets is controlled in recovery operation will be described referring to FIG. 5.

Figure 5:
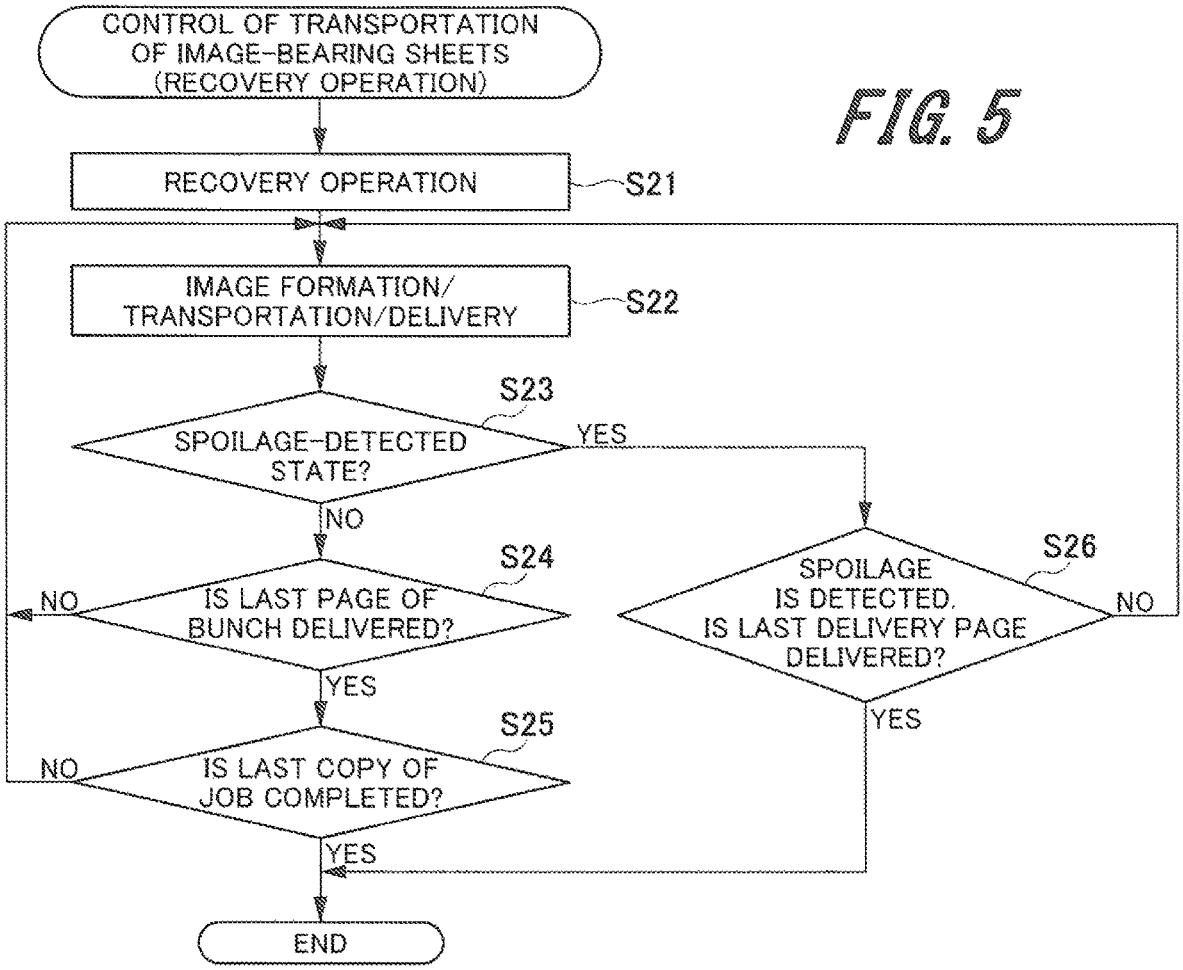
FIG. 5 is a flowchart which shows the control of transportation of an image-bearing sheet for recovery operation (resetting operation) in the image forming system according to the embodiment of the present invention.

FIG. 5 is a flowchart which shows the control of transportation of image-bearing sheets in recovery operation.

As shown in FIG. 5, after transportation is stopped upon spoilage detection, the controller 200 carries out recovery operation from a specified recovery page S1 (see FIGS. 7A to 7C, 8A to 8C, and 10A to 10C) (Step S21). The process to specify the recovery page S1 to be used at Step S21 will be described later.

Next, the controller 200 forms images and transports and delivers the sheets according to the job information (Step S22). In addition, the controller 200 receives the image reading result information from the image reader 30 and makes a determination on the images. Then, the controller 200 determines whether the current state is a spoilage-detected state in which a spoilage has been detected or not (Step S23). By taking Step S23 in this way, whether a spoilage has occurred again during recovery operation can be determined.

If at Step S23 the controller 200 determines that the current state is not a spoilage-detected state (determination at Step S23: NO), the controller 200 determines whether the last page of the bunch of sheets has been delivered or not (Step S24). If at Step S24 the controller 200 determines that the last page of the bunch of sheets has not been delivered (determination at Step S24: NO), the controller 200 returns to Step S22 and continues the job.

On the other hand, if at Step S24 the controller 200 determines that the last page of the bunch of sheets has been delivered, it determines whether the last copy (bunch) for the job has been completed (Step S25). At Step S25 in recovery operation, determination is made according to the specified number of copies for the job and the number of copies as spoilage bunches Q1 (see FIGS. 7A to 7C and 10A to 10C) which are counted by the memory 250 of the image forming device 20. Spoilage bunch Q1 will be described later.

If at Step S25 the controller 200 determines that the process for the last copy has not been completed (determination at Step S25: NO), the controller 200 returns to Step S22 and continues the job. If at Step S25 the controller 200 determines that the process for the last copy has been completed (determination at Step S25: YES), the controller 200 ends the job.

On the other hand, if at Step S23 the controller 200 determines that the current state is a spoilage-detected state (determination at Step S23: YES), the controller 200 determines whether the last delivery page S2 specified at the time of spoilage detection has been delivered or not (Step S26).

If at Step S26 the controller 200 determines that the last delivery page S2 has not been delivered yet (determination at Step S26: NO), the controller 200 returns to Step S22 and continues the job. If at Step S26 the controller 200 determines that the last delivery page S2 has been delivered (determination at Step S26: YES), it stops the transportation upon spoilage detection and then again performs the recovery operation process shown in FIG. 5.

2-2 Examples of Operation Upon Reception of an Image Reading Result

Next, how operation is performed at the time of reception of an image reading result, namely control upon reception of an image reading result, will be described referring to FIGS. 6 to 12.

[First Example of Operation]

First, the first example of operation is explained below referring to FIGS. 6, 7A to 7C and 8A to 8C.

Figure 6:
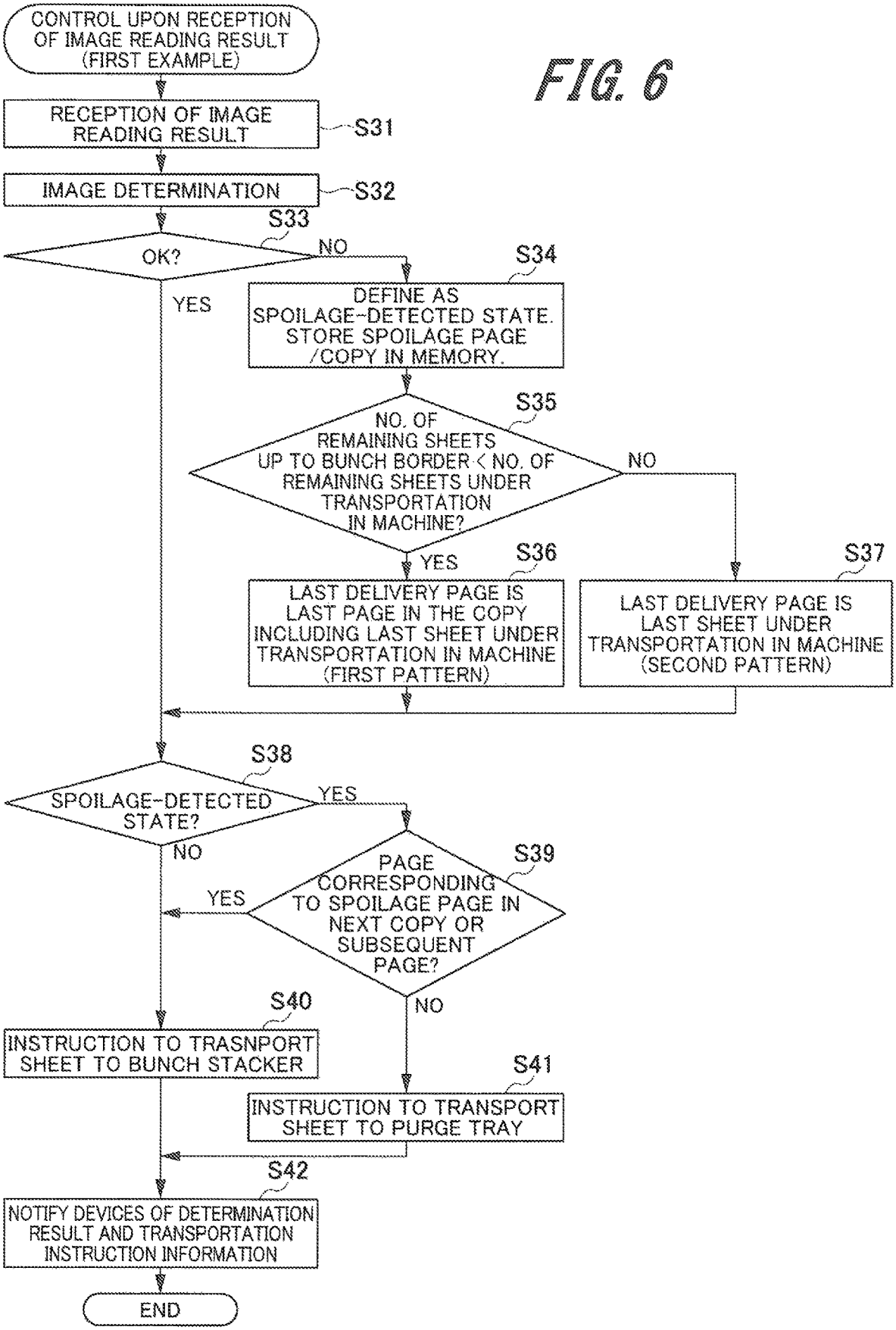
FIG. 6 is a flowchart which shows a first example of control upon reception of an image reading result in the image forming system according to the embodiment of the present invention.
Figures 7A, 7B, 7C:
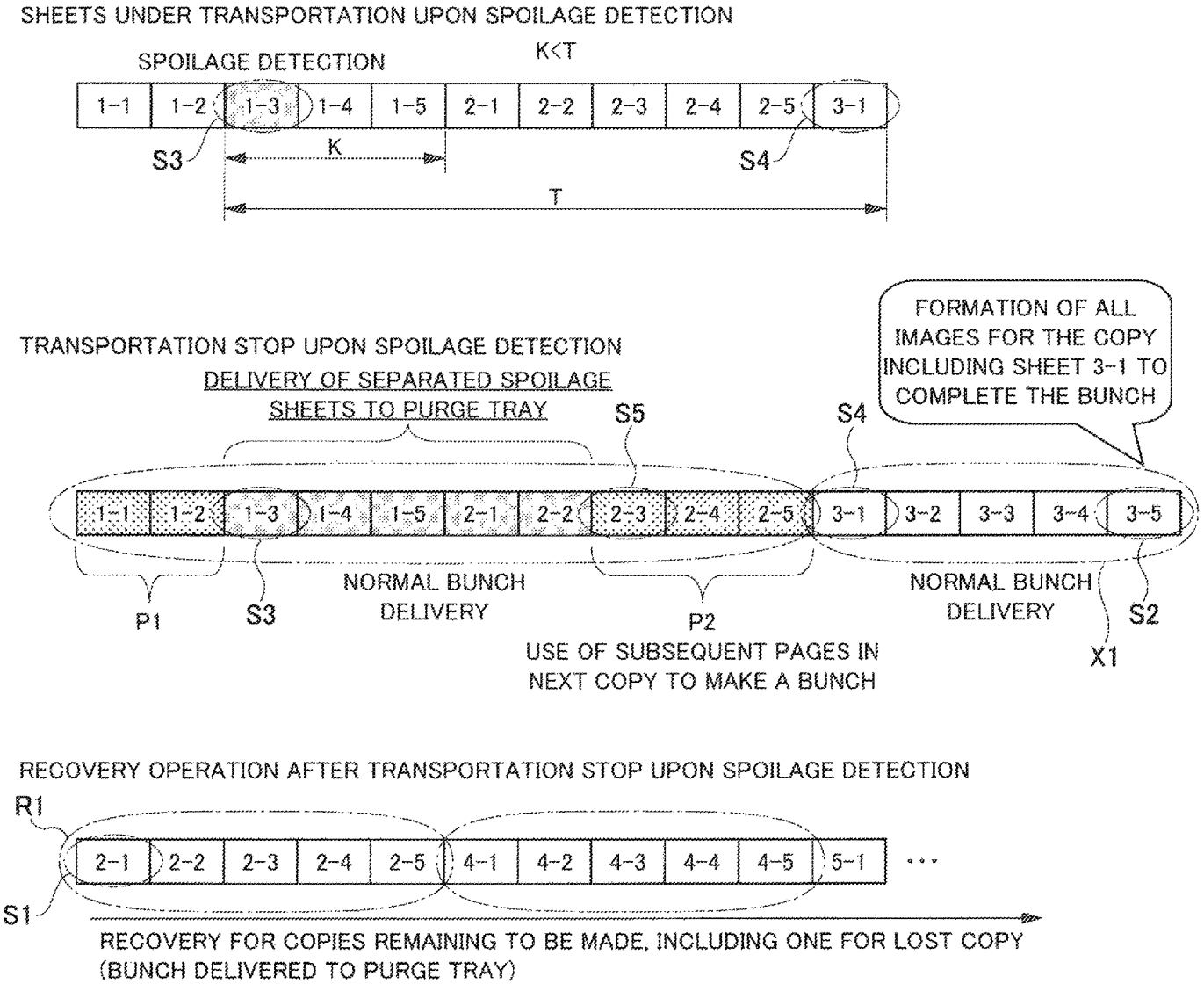
Figure 8A:
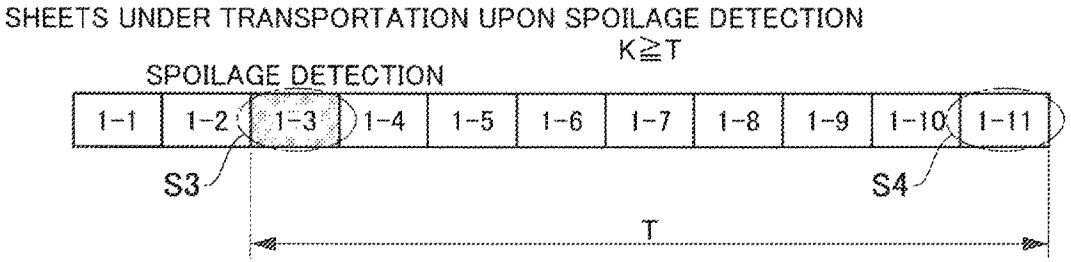
Figure 8B:
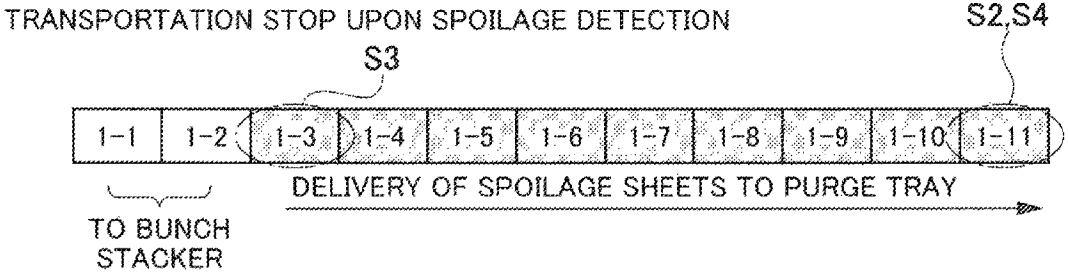
Figure 8C:
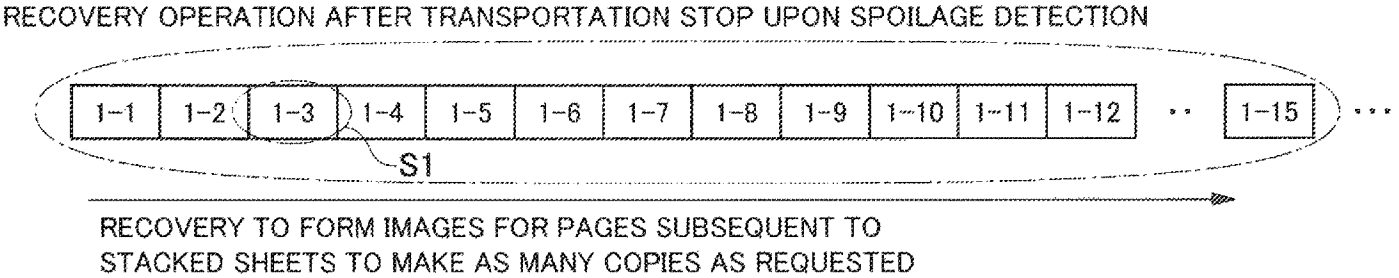

FIG. 6 is a flowchart which shows the first example of control upon reception of an image reading result. FIGS. 7A to 7C are explanatory diagrams which show a first pattern of the first example of control upon reception of an image reading result. FIGS. 8A to 8C are explanatory diagrams which show a second pattern of the first example of control upon reception of an image reading result.

As shown in FIG. 6, first, the controller 200 receives the image reading result information from the image reader 30 (Step 31). Then, the controller 200 makes a determination on the image on the current sheet S according to the image reading result information (Step S32). It determines whether the result of determination at Step S32 is OK or not, namely whether the image on the sheet S is defective (NG) or not defective (OK) (Step S33).

If at Step S33 the controller 200 determines that it is OK (determination at Step S33: YES), it carries out the process for Step S38 which will be described later.

On the other hand, if at Step S33 the controller 200 determines that it is not OK (determination at Step S33: NO), the determination means that the image on the sheet S is defective and a spoilage sheet S3 has been generated. Hereinafter a sheet in which spoilage has occurred is called spoilage sheet S3. Then, the controller 200 defines the state as a spoilage-detected state and stores the page of the spoilage sheet S3 in which the image defect has been generated, and the copy as the bunch of sheets including the spoilage sheet S3 in the memory 250 (Step S34).

Next, the controller 200 counts the number of remaining sheets from the spoilage sheet S3 to the sheet in the first bunch of sheets including the spoilage sheet S3 on the border with the next bunch of sheets, K, and the number of remaining sheets under transportation in the machine, T. The number of remaining sheets under transportation in the machine T is the number of sheets S remaining on the upstream of the spoilage sheet S3 in the transportation direction, namely from the spoilage sheet S3 to the sheets S remaining in the transportation path of the image forming system 1. The number of remaining sheets under transportation in the machine T is the number of sheets S reserved for processing in the image forming device 20.

Then, the controller 200 determines whether the number of remaining sheets up to the border of the first bunch of sheets, K, is smaller than the number of remaining sheets under transportation in the machine, T, (K<T) or not (Step S35). FIG. 7A shows an example that the job is to make a bunch of five sheets and the number of remaining sheets under transportation in the machine T is 9. As shown in FIG. 7A, if the third page of the first copy (bunch) (1-3) is a spoilage sheet S3, the number of remaining sheets up to the border of the bunch, K is 3, namely the third page as the spoilage sheet S3 (1-3), the fourth page (1-4) and the fifth page (1-5) in the first copy as the first bunch of sheets including the spoilage sheet S3. Consequently, in the example shown in FIG. 7A, the controller 200 determines that the number of remaining sheets up to the border of the bunch, K is smaller than the number of remaining sheets under transportation in the machine, T (K<T) (determination at Step S35: YES).

Then, the controller 200 specifies the last page in the sheet bunch including the last sheet S4 under transportation in the machine, namely the last one of the reserved sheets, as the last delivery page S2 (Step S36). Specifically, as shown in FIG. 7A, the last sheet S4 under transportation in the machine, namely the sheet on the most upstream among the reserved sheets, is the first page of the third copy (bunch). As shown in FIG. 7B, the last page (3-5) in the third copy as the sheet bunch including the last sheet S4 under transportation in the machine is specified as the last delivery page S2. The pattern shown in FIGS. 7A to 7C is the first pattern.

Furthermore, as shown in FIG. 7C, the controller 200 specifies the first page (2-1) in the second sheet bunch as the next copy (second copy) to the first sheet bunch including the spoilage sheet S3, as the recovery page S1 to be used at Step S21 in FIG. 5.

In the example shown in FIG. 8A, the job is to make a bunch of 15 sheets and the number of remaining sheets under transportation in the machine, T is 9. As shown in FIG. 8A, if the third page in the first copy (1-3) is a spoilage sheet S3, the number of sheets up to the border of the bunch, K is 13 sheets from the third page to the fifteenth page. Consequently, in the example shown in FIG. 8A, the controller 200 determines that the number of remaining sheets up to the border of the bunch, K is larger than the number of remaining sheets under transportation in the machine, T (K≥T) (determination at Step S35: NO).

Then, the controller 200 specifies the last sheet S4 under transportation in the machine, namely the last one of the reserved sheets, as the last delivery page S2 (Step S37). Specifically, as shown in FIG. 8A, the last sheet S4 under transportation in the machine, namely the sheet on the most upstream among the reserved sheets (1-11), is specified as the last delivery page S2. The pattern shown in FIGS. 8A to 8C is the second pattern. Furthermore, as shown in FIG. 8C, the controller 200 specifies the page of the spoilage sheet S3 (1-3) as the recovery page S1 to be used at Step S21 in FIG. 5.

The last delivery page S2 specified at Step S36 and Step S37 is used at Step S16 and Step S26 in the flowcharts of FIG. 4 and FIG. 5 respectively. The sheets up to the last delivery page S2 are sheets which are processed until transportation is stopped upon spoilage detection.

After the last delivery page S2 is specified at Step S36 or Step S37, the controller 200 determines whether the current state is a spoilage-detected state or not (Step S38). If at Step S38 the controller 200 determines that the current state is not a spoilage-detected state (determination at Step S38: NO), it performs the process for Step S40 which will be described later.

On the other hand, if at Step S38 the controller 200 determines that the current state is a spoilage-detected state (determination at Step S38: YES), it determines whether the current sheet is sheet S5 as the page in the next copy to the copy including the spoilage sheet S3, namely in the second sheet bunch, which corresponds to the spoilage page S3, or subsequent page (Step S39). In the example shown in FIG. 7A, the spoilage sheet S3 is detected as the third page in the first copy as the first sheet bunch. Therefore, the sheet S5 as the page in the second sheet bunch which corresponds to the spoilage sheet S3 is the third page in the second copy (2-3).

If the current sheet is not sheet S5 in the second sheet bunch as the page which corresponds to the detected spoilage page or subsequent page, in the example shown in FIGS. 7A and 7B, it is from the third page (1-3) in the first copy to the second page in the second copy (2-2). If at Step S39 the controller 200 determines that the current sheet is not sheet S5 in the second sheet bunch as the page which corresponds to the detected spoilage page or subsequent page (determination at Step S39: NO), the controller 200 instructs the spoilage delivery device 40 to transport the sheet to the purge tray 460 (Step S41). Specifically, as shown in FIGS. 7A and 7B, the sheets from the third page in the first copy (1-3) to the second page in the second copy (2-2) are delivered to the purge tray 460.

The number of sheets from the third page in the first copy (1-3) to the second page in the second copy (2-2) which are delivered to the purge tray 460 is the same as the number of sheets in a single bunch which is requested by the job. Therefore, the memory 250 counts the number of spoilage bunches Q1 as "1".

In the second pattern shown in FIGS. 8A and 8B, since the last delivery page S2 is the eleventh page in the first copy (1-11), the determination at Step S39 is always NO. Therefore, the sheets from the third page in the first copy (1-3) to the eleventh page (1-11) are delivered to the purge tray 460. This means that if a spoilage sheet S3 is generated, all the sheets remaining in the machine are delivered to the purge tray 460.

In this example, it is assumed that at Step S41 the sheets are delivered to the purge tray 460 of the spoilage delivery device 40. However, instead, an instruction may be given to transport the sheets to the sub tray 590 of the post-processing device 50.

On the other hand, if at Step S39 the controller 200 determines that the current sheet is sheet S5 as the page in the second sheet bunch which corresponds to the detected spoilage page S3 or subsequent page (determination at Step S39: YES), the controller 200 instructs the spoilage delivery device 40 and post-processing device 50 to transport the subsequent sheets S to the bunch processing stacker, namely the stacker 560 of the post-processing device 50 (Step S40).

Next, the controller 200 notifies the various devices of the judgment result and transportation instruction information (Step S42). The first example of control upon reception of an image reading result is thus completed. As indicated by Step S32 and S33, transported sheets S are subjected to determination of the image both before and after detection of a spoilage sheet S3. Consequently, the controller 200 is operated in consideration of so-called "multiple spoilage detection" in which after detection of a spoilage sheet S3, another spoilage sheet S3 is detected.

At Steps S16 and S26 shown in FIGS. 4 and 5 respectively, as the last delivery page S2 is delivered, the job is stopped. As a consequence, in the first pattern, as shown in FIG. 7B, the first page (1-1) to the second page (1-2) in the first copy as the first sheet bunch, the third page (2-3) to the fifth page (2-5) in the second copy as the second sheet bunch, and all the pages in the third copy (3-1 to 3-5) are transported to the stacker 560. The sheet group P1 which includes the first page (1-1) to the second page (1-2) in the first copy on the downstream side of the spoilage sheet S3 (1-3) has already been transported to the stacker 560. This sheet group P1 and the sheet group P2 which includes the third page (2-3) to the fifth page (2-5) in the second copy are used to make a bunch of sheets as requested by the job.

In other words, in the first pattern in the first example of operation, the first sheet bunch as the copy including the spoilage sheet S3 and the second sheet bunch as the next copy can be used. When a valid bunch of sheets can be made by using the remaining sheets in the machine in this way, the process to make valid bunches can be continued as far as possible so that the number of sheets invalidated upon detection of a defective image can be reduced without an escape area.

Furthermore, as mentioned above, in the first pattern, the number of sheets separated and delivered to the purge tray 460 is the same as the number of sheets in a single bunch as requested by the job. Therefore, as shown in FIG. 7C, recovery operation is performed to make as many copies as the number of copies remaining to be made as specified by the job, plus a copy with as many sheets as the number of sheets R1 separated and delivered to the purge tray 460 (equivalent to one spoilage bunch Q1). Consequently, as many bunches of sheets (copies) as specified by the job can be made.

Furthermore, in the second pattern, at Steps S16 and S26 shown in FIGS. 4 and 5 respectively, as the last delivery page S2 is delivered, the first page (1-1) and the second page (1-2) in the first copy are transported to the stacker 560 as shown in FIG. 8B. By specifying the third page in the first copy as recovery page S1 and forming images on other sheets, recovery printing can be performed to make as many copies as the number of copies remaining to be made as specified by the job.

[Second Example of Operation]

Next, the second example of operation will be explained referring to FIGS. 9 to 12.

Figure 10A:
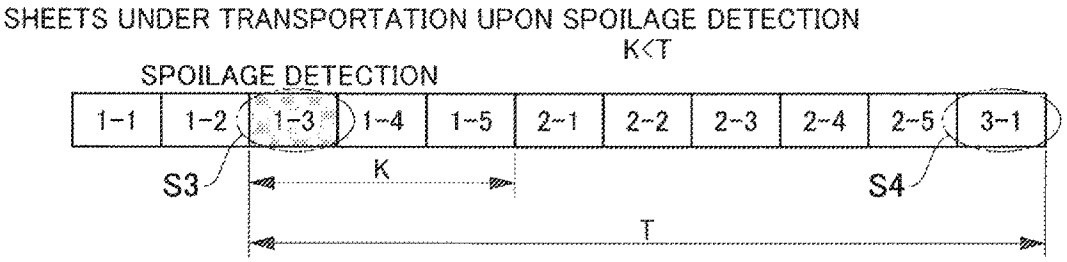
Figure 10B:
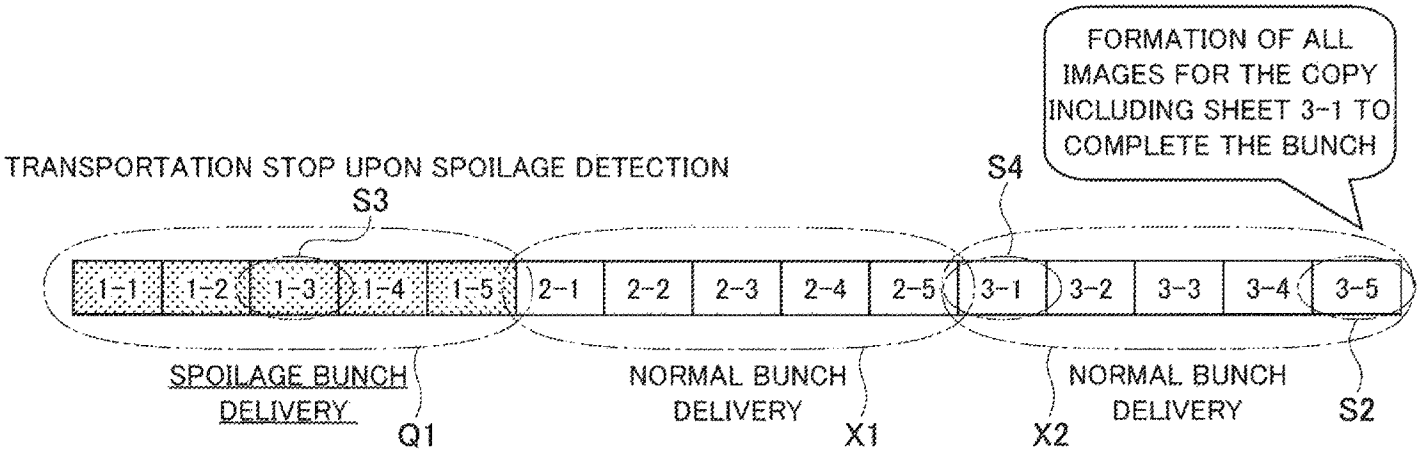
Figure 10C:
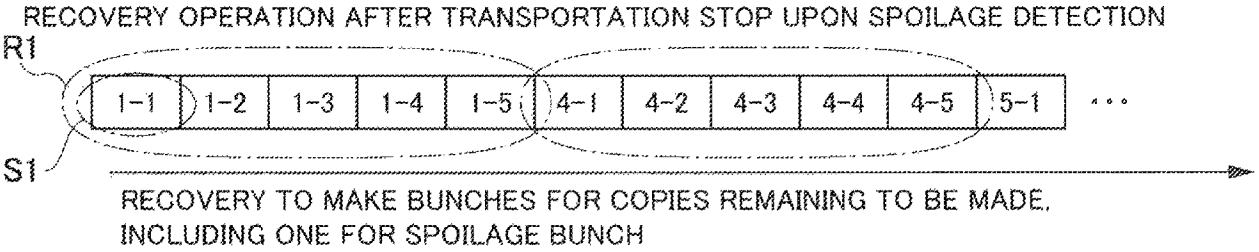

FIG. 9 is a flowchart which shows the second example of control upon reception of an image reading result. FIGS. 10A to 10C are explanatory diagrams which show a first pattern of the second example of control upon reception of an image reading result.

As shown in FIG. 9, first, the controller 200 receives the image reading result information from the image reader 30 (Step 51). Then, the controller 200 makes a determination on the image on the current sheet S according to the image reading result information (Step S52) and determines whether the image on the sheet S is defective (NG) or not defective (OK) (Step S53).

If at Step S53 the controller 200 determines that it is OK (determination at Step S53: YES), the controller 200 carries out the process for Step S58 which will be described later.

On the other hand, if at Step S53 the controller 200 determines that it is not OK (determination at Step S53: NO), it defines the state as a spoilage-detected state and stores the page of the spoilage sheet S3 in which the image defect has been generated, and the copy as the first bunch of sheets including the spoilage sheet S3 in the memory 250 (Step S54).

Then, the controller 200 determines whether the number of remaining sheets up to the border of the first bunch of sheets, K, is smaller than the number of remaining sheets under transportation in the machine, T, (K<T) or not (Step S55). FIG. 10A shows an example that the job is to make a bunch of five sheets and the number of remaining sheets under transportation in the machine T is 9. As shown in FIG. 10A, if the third page in the first copy (1-3) is a spoilage sheet S3, the number of remaining sheets up to the border of the bunch, K is 3, namely the third page as spoilage sheet S3 (1-3), the fourth page (1-4) and the fifth page (1-5) in the first copy as the first sheet bunch including the spoilage sheet S3. Consequently, in the example shown in FIG. 10A, the controller 200 determines that the number of remaining sheets up to the border of the bunch, K is smaller than the number of remaining sheets under transportation in the machine, T (K<T) (determination at Step S55: YES).

Then, the controller 200 specifies the last page in the copy including the last sheet S4 under transportation in the machine as the last delivery page S2 (Step S56). Specifically, as shown in FIG. 10B, the last page (3-5) in the third copy as the sheet bunch including the last sheet S4 under transportation in the machine is the last delivery page S2. The pattern shown in FIGS. 10A to 10C is the first pattern in the second example of operation.

Furthermore, as shown in FIG. 10C, the controller 200 specifies the first page (1-1) in the first copy including the spoilage sheet S3 as the recovery page S1 to be used at Step S21 in FIG. 5.

On the other hand, if the controller 200 determines that the number of remaining sheets up to the border of the bunch, K is larger than the number of remaining sheets under transportation in the machine T (K≥T) (determination at Step S55: NO), the controller 200 specifies the last sheet S4 under transportation in the machine as the last delivery page S2 (Step S57). Furthermore, as shown in FIG. 8C, the controller 200 specifies the page of the spoilage sheet S3 (1-3) as the recovery page S1 to be used at Step S21 in FIG. 5.

The last delivery page S2 specified at Step S56 or Step S57 is used at Step S16 and Step S26 in the flowcharts of FIG. 4 and FIG. 5 respectively. The sheets up to the last delivery page S2 are sheets which are processed until transportation is stopped upon spoilage detection.

After the last delivery page S2 is specified at Step S56 or Step S57, the controller 200 determines whether the current state is a spoilage-detected state or not (Step S58). If at Step S58 the controller 200 determines that the current state is not a spoilage-detected state (determination at Step S58: NO), the controller 200 performs the process for Step S60 which will be described later.

On the other hand, if at Step S58 the controller 200 determines that the current state is a spoilage-detected state (determination at Step S58: YES), it determines whether the last delivery page S2 is the last page in the copy including the last sheet S4 under transportation in the machine or not (Step S59). In the second pattern at Step S57, since the last sheet under transportation in the machine S4 is specified as the last delivery page S2, the determination at Step S59 is always NO. Therefore, in the second pattern, the controller 200 instructs the spoilage delivery device 40 to transport the sheet to the purge tray 460 (Step S61).

On the other hand, in the first pattern, at Step S56, since the last page in the copy including the last sheet S4 under transportation in the machine is specified as the last delivery page S2, the determination at Step S59 is always YES. Then, in the first pattern, the controller 200 instructs the spoilage delivery device 40 and post-processing device 50 to transport the sheet S to the bunch processing stacker, namely the stacker 560 of the post-processing device 50 (Step S60).

Therefore, as shown in FIG. 10B, in the first pattern, all the sheets up to the last delivery page S2 are delivered to the stacker 560 of the post-processing device 50. Then, spoilage bunch Q1 as the first sheet bunch including the spoilage sheet S3, the second sheet bunch X1 (second copy), and third sheet bunch X2 (third copy) as normal bunches (hereinafter simply called normal bunch X1) are stacked in the stacker 560. The number of spoilage bunches Q1 stacked in the stacker 560 is one bunch and thus the memory 250 counts the number of spoilage bunches Q1 as "1".

Next, the controller 200 notifies the various devices of the judgment result and transportation instruction information (Step S62). The second example of control upon reception of an image reading result is thus completed.

Then, as shown in FIG. 10C, in the first pattern in the second example of operation, recovery operation is performed to make as many copies as the number of copies remaining to be made as specified by the job, plus a copy (equivalent to one bunch) R1 for the spoilage bunch Q1 counted by the memory 250. Consequently, as many bunches of sheets (copies) as specified by the job can be made.

Also in the first pattern in the second example of operation, when a valid bunch of sheets can be made by using the remaining sheets in the machine, the process to make valid bunches can be continued as far as possible so that the number of invalidated sheets can be reduced without an escape area.

As mentioned above, since the spoilage bunch Q1 including the spoilage sheet S3 and normal bunches X1 are stacked in the stacker 560, the spoilage bunch Q1 as an invalid bunch must be removed from the stacker 560 or the delivery tray 580. Therefore, the controller 200 causes the operation display panel 240 to show which copy is a spoilage bunch Q1, in order to notify the user of the position of the spoilage bunch Q1. In addition, the controller 200 instructs the post-processing device 50 to perform post-processing for the spoilage bunch Q1 in a different manner from post-processing for the normal bunches X1.

Figure 11A:
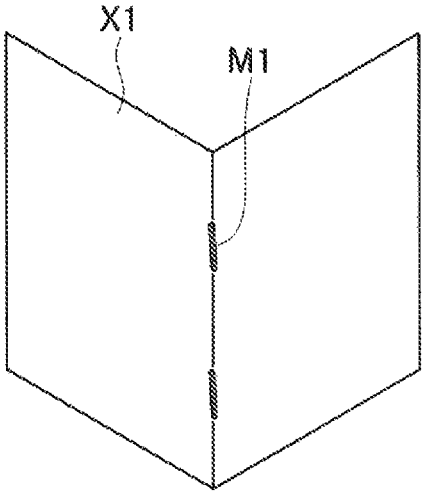
Figure 11B:
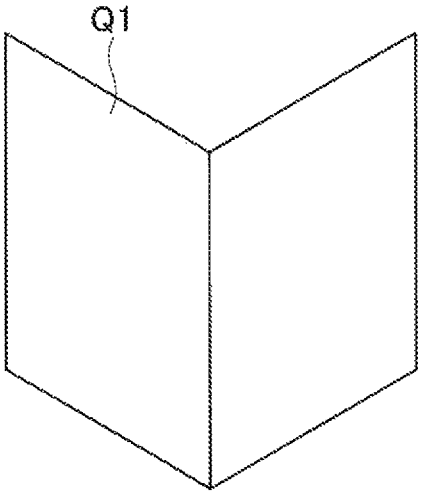

FIG. 11A and FIG. 11B are explanatory views which show an example of post-processing performed on spoilage bunch Q1 and normal bunch X1, in which FIG. 11A shows the normal bunch X1 and FIG. 11 B shows the spoilage bunch Q1.

For the normal bunch X1, as shown in FIG. 11A, after a center folding process is performed, a saddle stitching process is performed with staples M1. On the other hand, for the spoilage bunch Q1, as shown in FIG. 11B, only a center folding process is performed.

Figure 12A:
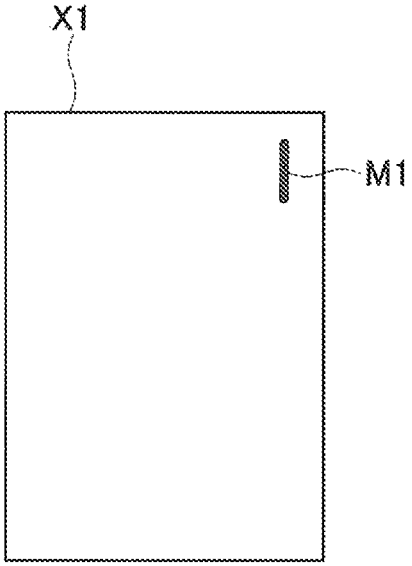
Figure 12B:
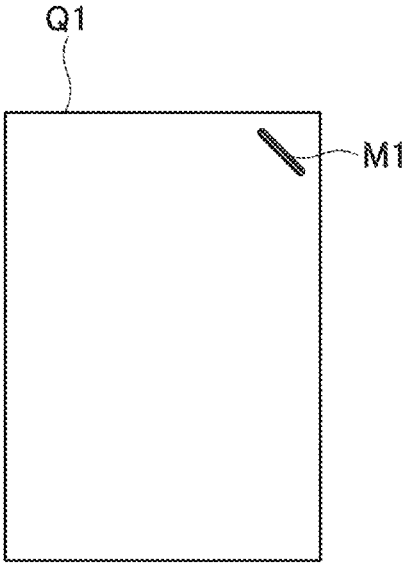

FIG. 12A and FIG. 12B are explanatory views which show another example of post-processing performed on the spoilage bunch Q1 and normal bunch X1, in which FIG. 12A shows the normal bunch X1 and FIG. 12 B shows the spoilage bunch Q1.

For the normal bunch X1, as shown in FIG. 12A, parallel stitching with staple M1 is made in the right upper corner. On the other hand, for the spoilage bunch Q1, as shown in FIG. 12B, oblique stitching with staple M1 is made in the right upper corner.

The type of post-processing which is performed on the normal bunch X1 and spoilage bunch Q1 is not limited to the abovementioned. Other various types of post-processing may be performed: for example, punching may be performed on the normal bunch X1 and not performed on the spoilage bunch Q1.

When the type of post-processing for a spoilage bunch Q1 is different from that for a normal bunch X1 as shown in FIGS. 11A, 11B, 12A and 12B, it is easier to distinguish a spoilage bunch Q1 from normal bunches X1, so a spoilage bunch Q1 can be removed easily.

2-3 Method for Setting Recovery Operation

Next, the method for setting recovery operation will be described referring to FIGS. 13 to 15. FIG. 13 is an explanatory view which shows an example of what is displayed on the operation display panel 240.

Another point is that recovery operation after detection of spoilage sheet S3, may be performed in the following two patterns: an abnormality detection-oriented pattern in which the user is promptly notified of the detection of spoilage sheet S3 and a job productivity-oriented pattern in which the user is notified of the detection of spoilage sheet S3 after end of the entire job. In the abnormality detection-oriented pattern, it is preferable that the user should start recovery operation "manually" after stop of transportation upon detection of spoilage sheet S3. In the productivity-oriented pattern, it is preferable that the image forming system 1 should start recovery operation "automatically" after stop of transportation upon detection of spoilage sheet S3.

For this reason, the controller 200 provides an automatic pattern to start recovery operation automatically and a manual pattern for the user to start recovery operation manually. Before starting a job, the controller 200 causes the operation display panel 240 to display, for example, what is shown in FIG. 13. As shown in FIG. 13, "YES" and "NO" buttons for image abnormality detection are displayed to enable the user to select whether to perform image abnormality detection or not. In addition, "AUTO" and "MANUAL" buttons for recovery operation after detection are displayed to enable the user to select the mode of recovery operation after detection.

Furthermore, the image forming system 1 may be made to select either the "abnormality detection-oriented pattern" or the "productivity-oriented pattern" for recovery operation. FIG. 14 is a flowchart which shows the recovery operation pattern selection process.

In the flowchart shown in FIG. 14, whether to select the "abnormality detection-oriented pattern (manual pattern)" or the "productivity-oriented pattern (automatic pattern)" is determined according to the number of copies remaining to be made for the job. As shown in FIG. 14, first the controller 200 determines whether the number of copies remaining to be made for the job after detection of a spoilage sheet S3 is 10 or larger (Step S81). In this example, at Step S81 the threshold is assumed to be 10 (copies) but the threshold is not limited to 10. The user can specify a desired value for the threshold.

If at Step S81 the controller 200 determines that the number of copies remaining to be made is smaller than 10 (determination at Step S81: NO), the controller 200 selects automatic recovery (Step S82). If at Step S81 the controller 200 determines that the number of copies remaining to be made is 10 or larger (determination at Step S81: YES), the controller 200 selects manual recovery (Step S83). The recovery operation pattern selection process is thus completed.

3. Examples of Guidance Messages

Next, an explanation will be given of examples of guidance messages which appear on the operation display panel 240 in association with various operation patterns and spoilage delivery modes, referring to FIG. 15.

FIG. 15 is a table which explains examples of guidance messages.

In FIG. 15, "AUTO/MANUAL" represents recovery operation patterns. In the "SPOILAGE BUNCH YES/NO" column, "YES" represents that a spoilage bunch Q1 is present together with a normal bunch X1 in the stacker 560 or the delivery tray 580. In other words, this case corresponds to the first pattern of the second example of control upon reception of an image reading result as shown in FIGS. 10A and 10B. In the "SPOILAGE BUNCH YES/NO" column, "NO" represents that a spoilage bunch Q1 is not present in the stacker 560 or the delivery tray 580. In other words, this case corresponds to the first pattern of the first example of control upon reception of an image reading result as shown in FIGS. 7A and 7B.

As shown in FIG. 15, if the recovery operation pattern is "AUTO", it means that the productivity-oriented pattern is selected and thus a guidance message appears at the end of the job. If the recovery operation pattern is "MANUAL", it means that the abnormality detection-oriented pattern is selected and thus a guidance message appears before start of recovery operation.

Furthermore, if the recovery operation pattern is "AUTO" and the case corresponds to "YES" in the "SPOILAGE BUNCH YES/NO" column, for example, the following guidance message appears: "There is a defective booklet. Remove the XX-th booklet." If the recovery operation pattern is "AUTO" and the case corresponds to "NO" in the "SPOILAGE BUNCH YES/NO" column, for example, the following guidance message appears: "A defective image sheet has been delivered to the purge tray."

If the recovery operation pattern is "MANUAL" and the case corresponds to "YES" in the "SPOILAGE BUNCH YES/NO" column, for example, the following guidance message appears: "There is a defective booklet. Remove the XX-th booklet." If the recovery operation pattern is "MANUAL" and the case corresponds to "NO" in the "SPOILAGE BUNCH YES/NO" column, for example, the following guidance message appears: "A defective image has been generated. Check the sheets in the purge tray."

The guidance messages are not limited to the examples shown in FIG. 15. Other various guidance messages may be displayed.

So far, the image forming system according to the embodiment of the present invention and its advantageous effects have been described. However, the image forming system according to the present invention is not limited to the above embodiment. The invention may be embodied in other various ways without departing from the gist of the present invention as described in the appended claims.

Although in the above embodiment, four image forming units are used to form a color image, an image forming device according to the present invention may use one image forming unit to form a monochrome image.

Furthermore, although in the above example the controller 200 of the image forming device 20 is used as a controller to control the operation for determination about a defective image, delivery of a defective image sheet and so on, the invention is not limited thereto. For example, the controller of the external device (client terminal, management device server, mobile terminal, etc.) which sends job information to the image forming device 20 may be used as such a controller.

Furthermore, although in the above example the operation display panel 240 of the image forming device 20 is used as the display section which displays the options as shown in FIG. 13 and the guidance messages as shown in FIG. 15, the invention is not limited thereto. The display section of the external device (client terminal, management device server, mobile terminal, etc.) which sends job information to the image forming device 20 may be used as such a display section.

The above elements, functions, processing sections and so on may be, in part or in whole, implemented by hardware such as integrated circuitry. Also, the above elements, functions and so on may be implemented by software so that a processor interprets and executes the program to perform the functions. The information such as programs, tables, and files to perform the functions may be stored in a memory, hard disk, or recording device such as an SSD (Solid State Drive) or in a recording medium such as an IC card, SD card, or DVD.

Although an embodiment of the present invention has been described and illustrated in detail, the disclosed embodiment is made for purposes of illustration and example only and not limitation. The scope of the present invention should be interpreted by terms of the appended claims.

REFERENCE SIGNS LIST

1 . . . image forming system,
10 . . . large-capacity paper feed unit,
20 . . . image forming device,
30 . . . image reader,
40 . . . spoilage delivery device,
50 . . . post-processing device,
200 . . . controller,
230 . . . paper conveyor,
240 . . . operation display panel,
250 . . . memory,
260 . . . image processing section,
270 . . . image forming section,
360 . . . image reading section,
460 . . . purge tray,
560 . . . stacker,
570 . . . post-processing section,
580 . . . delivery tray,
590 . . . sub tray,
Q1 . . . spoilage bunch,
S1 . . . recovery page,
S2 . . . last delivery page,
S3 . . . spoilage sheet,
S4 . . . last sheet under transportation in the machine

What is claimed is:

1. An image forming system comprising:

an image forming section which forms an image on a sheet according to job information;

an image reading section which reads the image formed on the sheet by the image forming section;

a post-processing section which is located downstream of the image reading section in a transportation direction for the sheet and performs post-processing on a bunch of sheets made by bundling a specified number of the sheets; and a controller which determines whether or not an image defect has occurred on the sheet according to image reading result information from the image reading section, wherein when the controller determines that an image defect has occurred on the sheet, if a number of sheets from a spoilage sheet bearing the image defect to a sheet in a first sheet bunch which is a sheet bunch including the spoilage sheet, on a border with a next sheet bunch, is smaller than a number of sheets from the spoilage sheet to a last sheet which is a most upstream sheet in the transportation direction among sheets reserved for processing in the image forming section, the controller continues a process to make sheet bunches up to a sheet bunch including the last sheet and then starts a recovery operation for copies remaining to be made as requested by the job information plus a copy equivalent to the sheet bunch including the spoilage sheet.

2. The image forming system according to claim 1, wherein when continuing the process to make the sheet bunches up to the sheet bunch including the last sheet, the controller delivers sheets from the spoilage sheet to a sheet which is a page before a page corresponding to the spoilage sheet, in a second sheet bunch which is a next copy to the first sheet bunch, to a place different from a place for post-processing and transports sheets from the page corresponding to the spoilage sheet in the second sheet bunch to the post-processing section.

3. The image forming system according to claim 1, wherein when continuing the process to make the sheet bunches up to the sheet bunch including the last sheet, the controller transports not only the bunches that are continued to be made but also the first sheet bunch including the spoilage sheet to the post-processing section.

4. The image forming system according to claim 3, wherein the controller instructs the post-processing section to perform post-processing on the first sheet bunch in the post-processing section in a different manner from post-processing on a normal sheet bunch not including the spoilage sheet.

5. The image forming system according to claim 1, wherein, when the controller determines that an image defect has occurred on the sheet, if the number of sheets from the spoilage sheet to the sheet in the first sheet bunch on the border is larger than the number of sheets from the spoilage sheet to the last sheet, the controller delivers the reserved sheets including the spoilage sheet to a place different from a place for post-processing and then starts the recovery operation from a page corresponding to the spoilage sheet to make as many copies as a number of copies remaining to be made as requested by the job information.

6. The image forming system according to claim 1, wherein the controller provides an automatic pattern to start the recovery operation automatically and a manual pattern to enable a user to start the recovery operation manually.

7. The image forming system according to claim 6, wherein the controller selects either the automatic pattern or the manual pattern depending on a number of copies remaining to be made according to the job information.

* * * * *